United States Patent [19]

Mitsumasu

[11] 4,015,841

[45] Apr. 5, 1977

[54] SORTER

[75] Inventor: Sakae Mitsumasu, Ebina, Japan

[73] Assignee: Rank Xerox Ltd., London, England

[22] Filed: May 24, 1976

[21] Appl. No.: 689,290

[30] Foreign Application Priority Data

Sept. 11, 1975 Japan ..... 50-124332[U]

[52] U.S. Cl. ..... 271/173; 270/58; 74/37

[51] Int. Cl.[2] ..... B65H 39/10

[58] Field of Search ..... 271/64, 173; 270/58; 74/37, 567, 568 FS, 568 T, 568 M

[56] References Cited

UNITED STATES PATENTS

| | | | |
|---|---|---|---|
| 2,661,209 | 12/1953 | McGalliard | 271/173 |
| 3,586,311 | 6/1971 | Schulze | 271/173 |

*Primary Examiner*—Richard A. Schacher

[57] ABSTRACT

A sorting apparatus for collating sheets into sets. The sheets are conveyed along a desired path and a plurality of sheet receiving bins are arranged along the path. Guide members associated with each of the bins are arranged to sequentially remove a sheet from the conveyor and guide it into its respective bin. The guide members are actuated by a drive system which includes a cam comprising a web having a cam surface with at least one discontinuity and follower members associated with each of the guide members in responsive engagement with the cam surface. The discontinuities can comprise slots, holes, or notches in the web. The web may be wound up on a take-up reel or it can comprise an endless type belt.

8 Claims, 13 Drawing Figures

SORTER

This invention relates to an improved sorter and sorter drive system.

The present invention provides an arrangement wherein the distribution of sheets of copy paper or the like may be effected by movable guide means controlled to be moved between operative and inoperative positions by a unique drive mechanism.

The provision of rollers for each receiving bin is, therefore, unnecessary so that the spacing between the receiving bins can be narrowed thereby providing a more compact sorter.

Moreover, since the number of rollers may be reduced, the entire structure becomes simpler, and as a result, there is improved reliability during operation even at a high speed.

Figure 4:
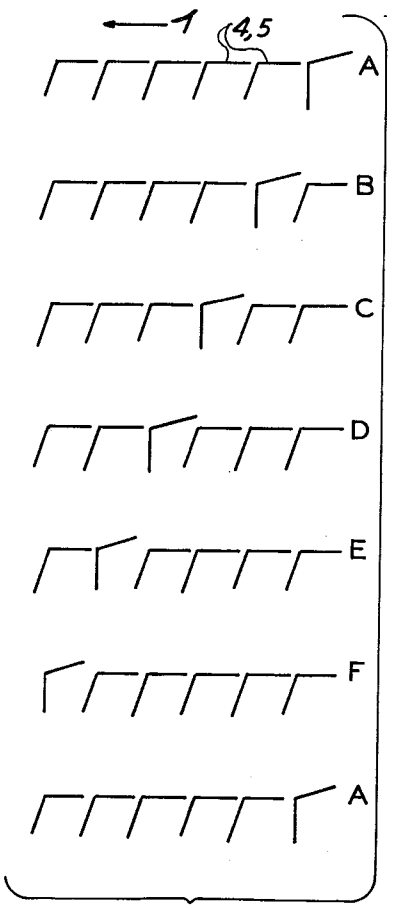

FIG. 4 schematically illustrates operation of the sorter according to one embodiment.

Figure 5:
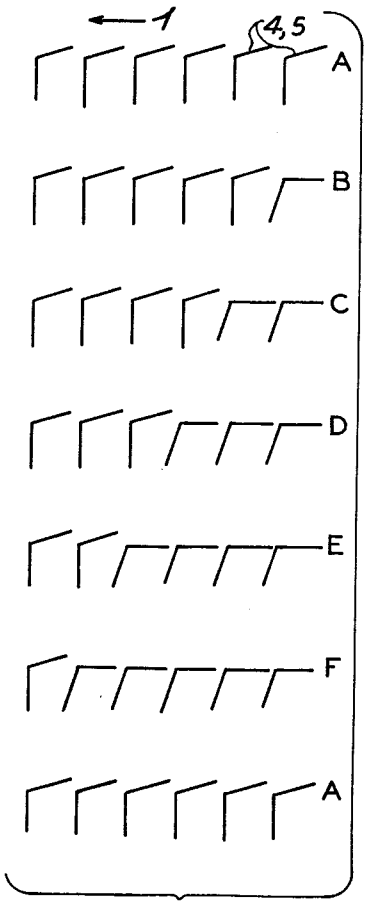

FIG. 5 schematically illustrates operation of the sorter according to another embodiment.

Figure 6:
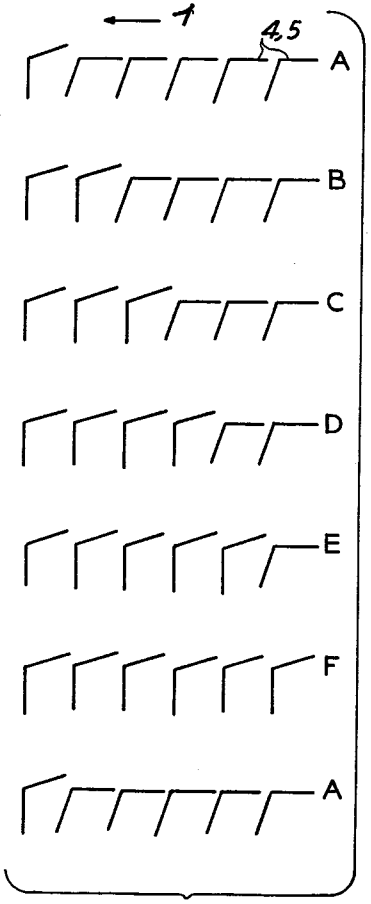

FIG. 6 schematically illustrates operation of the sorter according to yet another embodiment.

Figure 7:
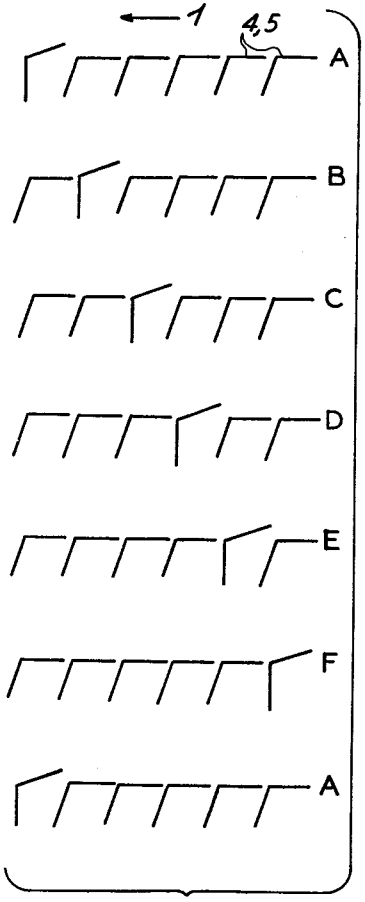

FIG. 7 schematically illustrates operation of the sorter according to a still further embodiment.

Figure 8:
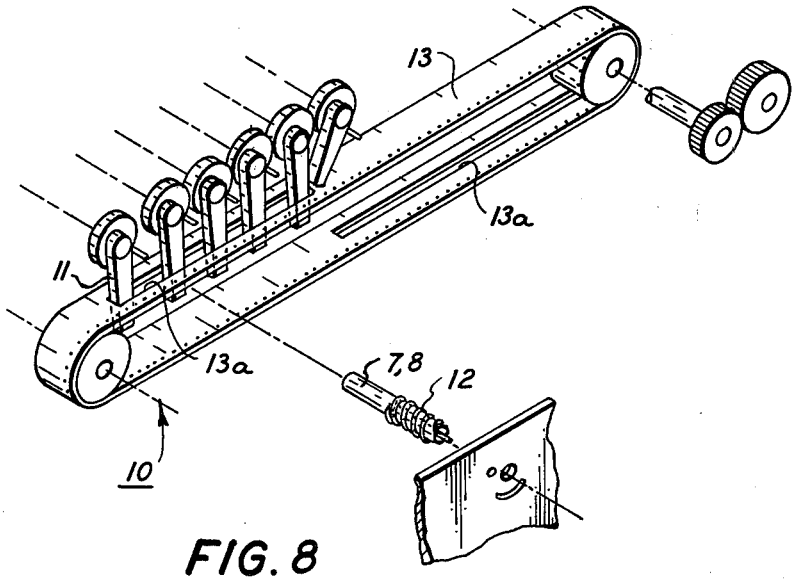

FIG. 8 is a perspective view of a drive mechanism in accordance with one embodiment of this invention.

Figure 9:
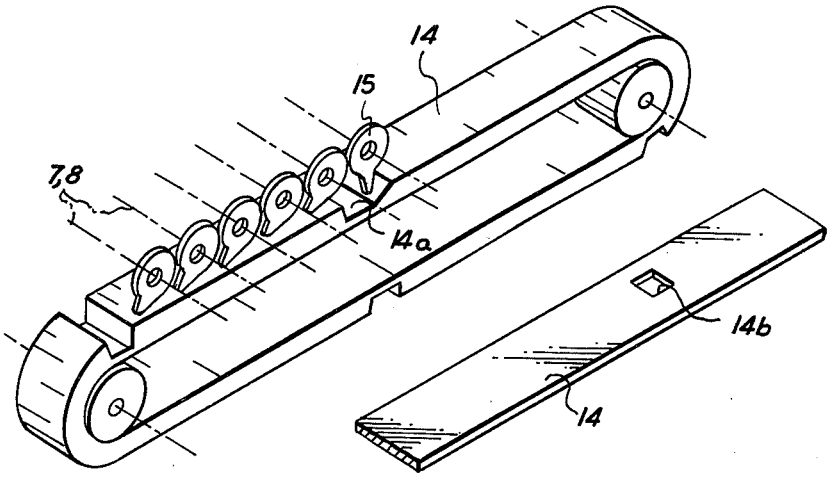

FIG. 9 is a perspective view of a drive mechanism in accordance with another embodiment of this invention.

Figure 10:
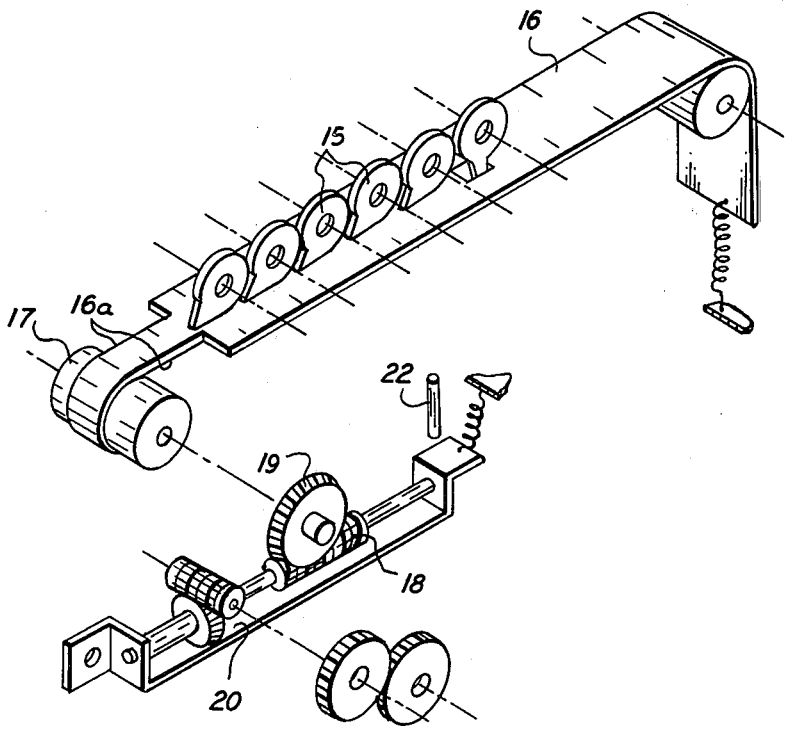

FIG. 10 is a perspective view of a drive mechanism in accordance with yet another embodiment of this invention.

Figure 11:
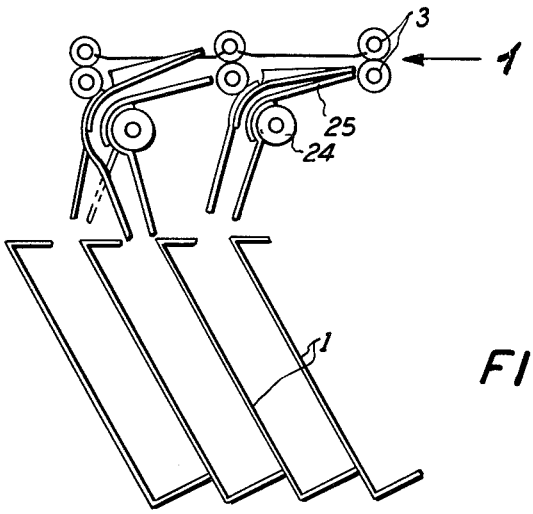

FIG. 11 is a schematic view of a sheet guiding arrangement in accordance with one embodiment of this invention.

Figure 12:
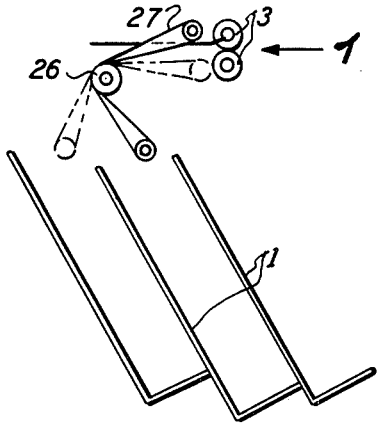

FIG. 12 is a schematic view of a sheet guiding arrangement in accordance with another embodiment of this invention.

Figure 13:
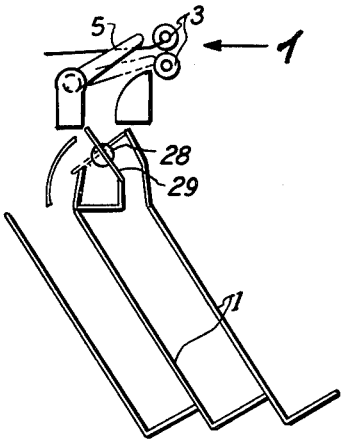

FIG. 13 is a schematic view of a sheet guiding arrangement in accordance with yet another embodiment of this invention.

This invention relates to a sorter for arranging pages of copy paper or printed paper in cooperation with a copier or a printing press.

Heretofore, copy paper or printed paper (hereinafter merely referred to a "copy paper or the like") copied or printed by copiers or printing presses have been collated by a sorter. However, with the recent trend toward increasing the number of pages of copy paper or the like, and the sets thereof, the number of sorter bins required has increased. An increase in the number of sorter bins causes the sorter itself to be very large, which is disadvantageous since additional space for the sorter is required.

Figure 1:
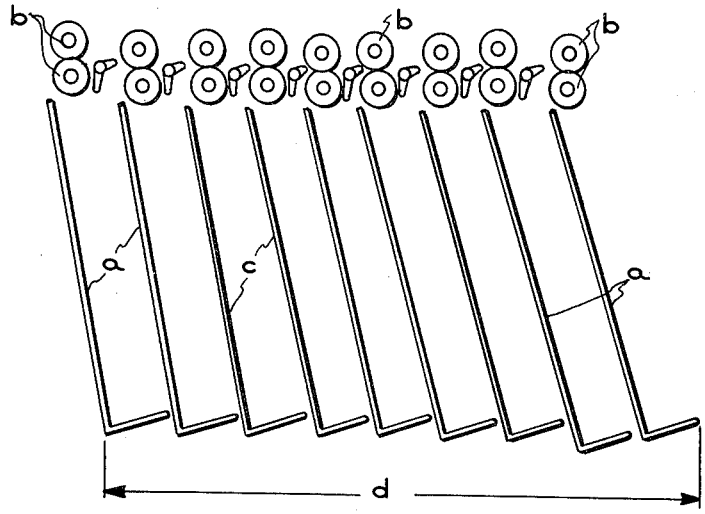
FIG. 1 is a schematic view showing a conventional sorter.

As shown in FIG. 1, a prior art sorter has a pair of rollers *b* for feeding sheets of paper provided at each inlet of a receiving bin shelf *a*, and this will not allow the spacing *c* between the receiving shelves *a*, to be narrowed. Therefore, if the number of shelves is increased, the entire width *d* inevitably becomes greater, so the sorter itself is very large. Another disadvantage is that many rollers *b*, which are rotated at high speed, must be used thereby rendering the construction complicated.

This invention overcomes those disadvantages as noted above and has its object to provide a sorter, which is simple in construction, with closer spacings between receiving shelves. A unique drive arrangement also forms part of the invention.

Figure 2:
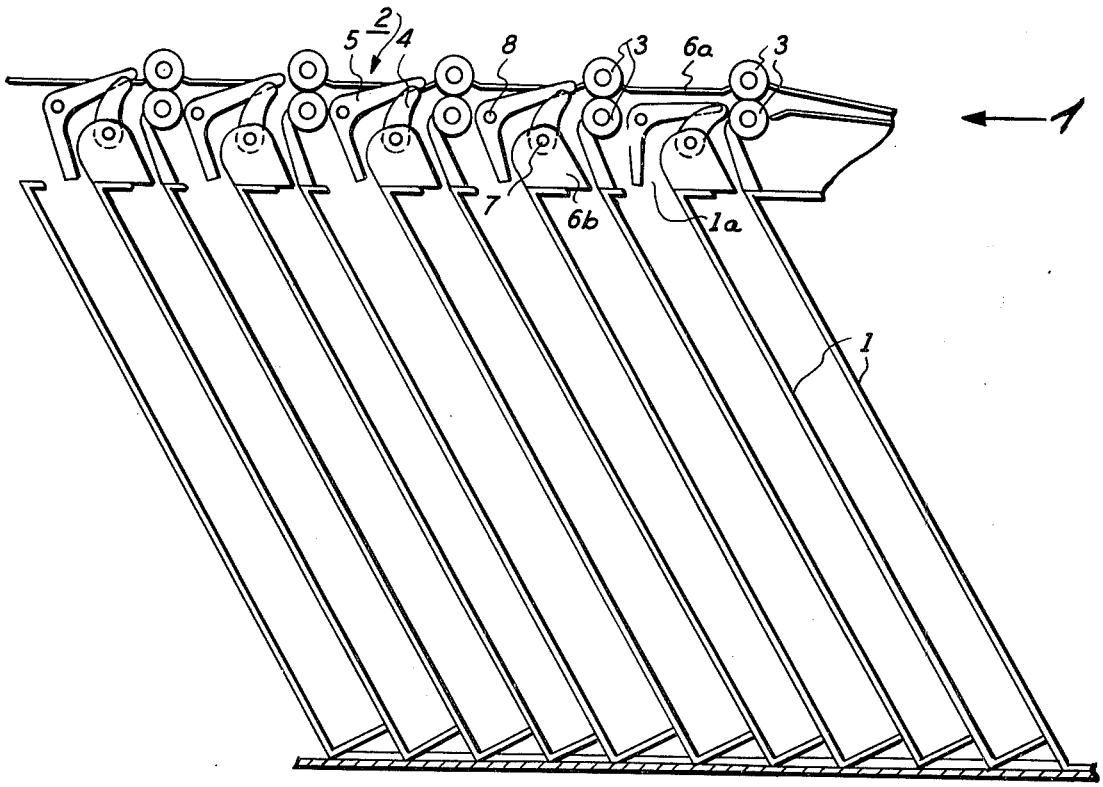
FIG. 2 is a schematic view of a sorter showing one embodiment according to the present invention.
Figure 3:
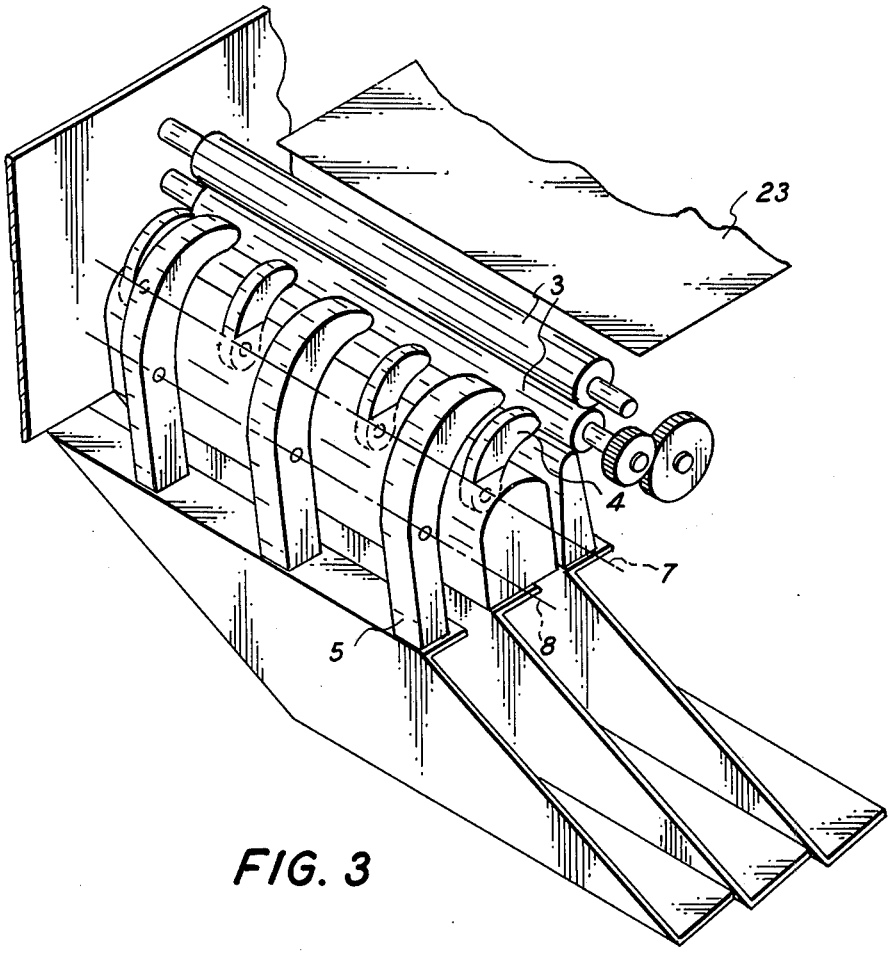
FIG. 3 is a perspective view of the sorter of FIG. 2.

The present invention will now be described by way of one embodiment shown in FIG. 2. In FIG. 2, there is shown a sorter with receiving shelves 1 which define a plurality of bins, for example, 10 bins. Five sets of distribution means 2 each associated with a set of two shelves, are mounted upwardly of inlets 1*a* of the receiving shelves 1. Each distribution means 2 comprises a pair of rollers 3 which are in pressure contact with each other. Long and short movable guide pawls 4 and 5 are positioned at the rear of the rollers 3 and are adapted to move up and down. A guide plate 6*a* is positioned above the movable guide pawls 4 and 5 and is disposed horizontally between the rollers 3. The short movable guide pawl 4 has its base portion inserted into a guide member 6*b* placed at the bin entrance and is fixedly mounted on a drive shaft 7 journaled within the guide member 6*b*. The long movable guide pawl 5 having a concave surface (paper path) is fixedly mounted on a drive shaft 8 supported at the rear of the movable guide pawl 4. The movable guide pawls 4 and 5 are supported on the drive shafts 7 and 8, respectively, in spaced apart relation in a direction transverse to the arrow.

At the ends of the drive shafts 7 and 8, there are connected a drive mechanism 10 of this invention for sequentially continuously moving up and down the movable guide pawls 4 and 5. This drive mechanism 10 is constructed, for example, as shown in FIGS. 8 through 10. In the embodiment of FIG. 8 the drive shafts 7 and 8 have one end provided with a follower 11, one end of which is secured to the shaft end. The drive shafts 7 and 8 have their other end provided with a return spring 12, which rotatably biases the drive shafts 7 and 8 in one direction. The other end of each follower 11 is slidably engaged with an endless belt or web-type cam which is driven by suitable driving source. The endless belt 13 is suitably formed with one or more slots 13*a*. As the slot or slots travel, the aforementioned movable guide pawls 4 and 5 are sequentially moved up and down through the action of followers 11. In the embodiment of FIG. 9, on the other hand, a thicker endless belt 14 includes a notch 14*a*, and as the notch 14*a* passes a follower 15 fixed to the drive shafts 7 and 8, the movable guide pawls 4 and 5 are moved up and down. Alternatively, the endless belt 14 may also be formed with a hole 14*b*.

Further, in the embodiment of FIG. 10, one end of a belt 16 formed with a notch 16*a* is drawn by a tension spring. A take-up drum 17 is provided at the other end of the belt 16 to wind up the belt 16. The drum 17 is connected to gear 19 meshed with a worm 18 which is rotated by a suitable driving source. The worm 18 is rotatably supported in a frame 20 whose one end is journaled. The other end of the frame 20 is biased toward the gear 19 by means of the tension spring. A solenoid 22 is mounted upwardly on the free end of the frame 20 is moved down to disengage the worm 18 from the gear 19. As a result, the belt 16 is returned to its original position by means of the tension spring.

Upward and downward movement of the movable guide pawls 4 and 5 may be effected by employment of any one of drive mechanisms as described above.

Referring to FIG. 2, the copy paper or the like is fed from the copier or printing press in the direction indicated by arrow (A) to the distribution means 2. In the distribution means 2, the movable guide pawls 4 and 5 are selectively moved up and down by the drive mechanism 10 as shown in FIG. 4 step (A) to guide a first sheet of copy paper or the like into the first bin receiving shelf 1. Thereafter, the movable guide pawls 4 and 5 are sequentially moved up and down as shown in FIGS. 4 steps B through F to sequentially distribute the sheets of copy paper of the like into the respective bins.

While a description has been given in FIG. 4 of the case where the movable guide pawls 4 or 5 in a downstate are sequentially moved up and down from right to left as viewed in the figure for the purpose of distributing the sheets of paper, it will be appreciated that all of movable guide pawls 4 and 5 could be in the up position as shown in FIG. 5 step (A) and sequentially dropped down as in FIG. 5 steps (B–F) from the right to left as viewed in the figure. Alternatively, the movable guide pawls 4 and 5 may be raised up sequentially from left to right as viewed in the figure as shown in FIG. 6, steps (A) to (F), or they may be individually moved up and down sequentially from the left as viewed in FIG. 7, steps (A) through (F) so as to distribute the sheets of copy paper or the like.

Other embodiments of the invention are illustrated in FIGS. 11 through 13, in which the aforementioned movable guide pawls 4 and 5 are replaced by another means.

In the embodiment of FIG. 11, there is provided a chute 25, which is rotatably supported on a shaft 24, for distributing the sheets sequentially into two adjacent bins. A lower guide plate is fixed between the rolls 3 and an upper guide plate is operated and driven in the manner of the guide pawls 4 and 5. The drives for the chute 24 may be similar to those for the pawls 4 and 5.

In the embodiment of FIG. 12, there is provided an endless belt 27, which is oscillated about shaft 26 to raise or lower its leading end to intercept a sheet conveyed in the direction of arrow A. The belt 27 is oscillated about shaft 26 so that its trailing end as shown distributes the sheet into the desired one of the two bin sets.

Finally, in the embodiment of FIG. 13, there is provided only the movable guide pawl 5 as well as an oscillating plate 29, which oscillates on a shaft 28 to distribute the sheets into the desired one of the two bin sets. Control for the embodiments of FIGS. 11–13 may be effected by a drive mechanism 10 similar to that described above to sequentially distribute copy paper or the like into the respective receiving bin shelves 1.

What is claimed is:

1. In a sorting apparatus for collating sheets into sets comprising:

means for conveying said sheets along a desired path;

a plurality of sheet receiving bins arranged along said path;

means for distributing said sheets from said conveying means sequentially into said sheet receiving bins, said distributing means including a plurality of movable guide members associated with said bins for removing sheets from said conveying means and guiding them into said bins, and means for moving sequentially each of said guide members between a first position wherein said guide member will remove a sheet from said conveying means and guide it into a bin associated with said guide member and a second position wherein said guide member will not remove a sheet from said conveying means;

the improvement wherein said means for moving said guide members includes:

a cam comprising a web having a cam surface with at least one discontinuity therein; and at least one follower member connected to each of said guide members, each of said follower members being arranged to responsively engage said cam surface;

whereby said follower members sequentially move said guide members between said first and second positions responsive to said discontinuity in said cam surface.

2. An apparatus as in claim 1, wherein said discontinuity comprises a hole in said web.

3. An apparatus as in claim 1, wherein said discontinuity comprises a notch in said web.

4. An apparatus as in claim 1, wherein said web comprises an endless belt.

5. An apparatus as in claim 1, wherein each of said guide members are supported upon a shaft and wherein said follower members comprise a lever, one end of which is secured to said shaft and the other end of which engages said cam surface.

6. An apparatus as in claim 1, wherein said means for moving said guide members includes a take-up drum for winding up said web and means for selectively driving said drum to wind and unwind said web therefrom.

7. An apparatus as in claim 6, wherein said selective drive means includes solenoid actuating means for selectively driving said take-up drum.

8. An apparatus as in claim 1, wherein said guide members comprises first guide members and further including second guide members receiving said sheets from said first guide members for distributing sheets into one of two adjacent bins, said second guide members being movable between a first position wherein sheets are distributed into a first of said two bins, and a second position wherein sheets are distributed into a second of said two bins.

* * * * *